US005627002A

United States Patent [19]

Pan et al.

[11] Patent Number: 5,627,002

[45] Date of Patent: May 6, 1997

[54] LIQUID DEVELOPER COMPOSITIONS WITH CYCLODEXTRINS

[75] Inventors: David H. Pan, Rochester; Scott D. Chamberlain, Macedon; George A. Gibson, Fairport; John W. Spiewak, Webster; Frank J. Bonsignore, Rochester, all of N.Y.

[73] Assignee: Xerox Corporation, Stamford, Conn.

[21] Appl. No.: 690,881

[22] Filed: Aug. 2, 1996

[51] Int. Cl.[6] ..... G03G 9/135

[52] U.S. Cl. ..... 430/115

[58] Field of Search ..... 430/115

[56] References Cited

U.S. PATENT DOCUMENTS

| | | | |
|---|---|---|---|
| 5,019,477 | 5/1991 | Felder | 430/115 |
| 5,030,535 | 7/1991 | Drappel et al. | 430/116 |
| 5,049,467 | 9/1991 | Yamanaka | 430/110 |
| 5,318,883 | 6/1994 | Yamanaka et al. | 430/110 |
| 5,352,563 | 10/1994 | Kawasaki et al. | 430/264 |
| 5,409,803 | 4/1995 | Santos et al. | 430/331 |
| 5,501,934 | 3/1996 | Sukata et al. | 430/110 |

*Primary Examiner*—Roland Martin
*Attorney, Agent, or Firm*—E. O. Palazzo

[57] ABSTRACT

A positively charged liquid developer comprised of a non-polar liquid, thermoplastic resin particles, pigment, a charge director, and a charge control agent comprised of a cyclodextrin or a cyclodextrin derivative containing one or more organic basic amino groups.

24 Claims, No Drawings

LIQUID DEVELOPER COMPOSITIONS WITH CYCLODEXTRINS

BACKGROUND OF THE INVENTION

This invention is generally directed to liquid developer compositions and the improved developed images obtained thereof in electrographic image on image printing processes wherein a stylus provides, or writes the image pattern on a dielectric receptor, and more specifically, the present invention relates to a liquid developer containing certain charge control agents. More specifically, the present invention relates to positively charged liquid developers comprised of a nonpolar liquid, pigment, or dye, cyclodextrin charge control agent and a charge director, and which developers possess a number of advantages including the development and generation of images with improved image quality. The developers of the present invention in embodiments provide images with higher reflective optical density (ROD) and/or lower residual voltages ($V_{out}$). Higher reflective optical densities provide images with deeper, richer desirable color or more extended chroma. Lower residual image voltages enable the printing of subsequently applied layers to a higher reflective optical density and decrease or eliminate image defects such as smearing and shifts in $L^*a^*b^*$ color space (hue shifts) when one colored layer is overlaid on a second layer of different color. Series-Capacitance Data was utilized as a means of measuring the total charge in the liquid developer formulation, and which measurements indicate that placing too much charge on the toner or developer particles can cause lower RODs to occur, which is a manifestation of inferior image quality because less chroma would occur. Moreover, there can be added to the liquid developers of the present invention in embodiments thereof charge directors of the formulas as illustrated in copending application U.S. Ser. No. 08/505,043, now U.S. Pat. No. 5,563,015, especially a mixture of Alohas and EMPHOS PS-900™, or Alohas alone, an aluminum-di-tertiary butyl salicylate, the disclosure of which is totally incorporated herein by reference.

The developers can discharge the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems. Insufficient particle charge can result in poor image quality and also can result in poor transfer of the liquid developer or solids thereof to paper or other final substrates. Poor transfer can, for example, result in poor solid area coverage if insufficient toner is transferred to the final substrate and can also cause image defects such as smears and hollowed fine features. Conversely, overcharging the toner particles can result in low reflective optical density images or poor color richness or chroma since only a few very highly charged particles can discharge all the charge on the dielectric receptor causing too little toner to be deposited. To overcome or minimize such problems, the liquid toners, or developers of the present invention were arrived at after extensive research, and which developers result in, for example, sufficient particle charge to enable effective transfer but not so much charge as to yield images with lower optical densities and lower residual voltages because of excess toner charge. An advantage associated with the present invention includes controlling the increase of the desired positive charge on the developer particles.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and developing the image with a liquid developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid alkyl esters, NUCREL® may be selected.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Lithographic toners with cyclodextrins as antiprecipitants, and silver halide developers with cyclodextrins are known, reference U.S. Pat. Nos. 5,409,803, and 5,352,563, the disclosures of which are totally incorporated herein by reference.

Illustrated in U.S. Pat. No. 5,306,591 is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 a liquid developer comprised of thermoplastic resin particles, and a charge director comprised of an ammonium AB diblock copolymer, and in U.S. Pat. No. 5,307,731 (a liquid developer comprised of a liquid, thermoplastic resin particles, a nonpolar liquid soluble charge director, and a charge adjuvant comprised of a metal hydroxycarboxylic acid, the disclosures of each of these patents being totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., wherein contacting occurs while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

SUMMARY OF THE INVENTION

Examples of objects of the present invention include:

It is an object of the present invention to provide a liquid developer with many of the advantages illustrated herein.

Another object of the present invention resides in the provision of a liquid developer capable of controlled or modulated particle charging for image quality optimization.

It is a further object of the invention to provide a liquid developer wherein there are selected as charge control agents or additives cyclodextrins and organic basic nitrogenous derivatives of cyclodextrins.

It is still a further object of the invention to provide positively charged liquid developers wherein developed image defects, such as smearing, loss of resolution and loss of density, and color shifts in prints having magenta images overlaid with yellow images are eliminated or minimized.

Also, in another object of the present invention there are provided positively charged liquid developers with certain charge control agents that are in embodiments superior to liquid developers with no charge additive in that they result in higher reflective optical density (ROD) and/or lower residual ($V_{out}$) for developed images wherein the liquid toner contains these charge control agents.

Furthermore, in another object of the present invention there are provided liquid toners that enable excellent image characteristics, and which toners enhance the positive charge of the resin, such as ELVAX®, based colored toners.

These and other objects of the present invention can be accomplished in embodiments by the provision of liquid developers. In embodiments, the present invention is directed to liquid developers comprised of a nonpolar liquid, pigment, resin, preferably thermoplastic resin, a cyclodextrin charge control agent, and a charge director, such as a mixture of the aluminum salts of alkylated salicylic acid, like, for example, hydroxy bis[3,5-tertiary butyl salicylic] aluminate and EMPHOS PS-900®, reference U.S. Ser. No. 08/505,043, now U.S. Pat. No. 5,563,015, the disclosure of which is totally incorporated herein by reference.

Examples of charge directors present in various effective amounts of, for example, from about 0.001 to about 5, and preferably from about 0.005 to about 1 weight percent or parts, include aluminum di-tertiarybutyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis [monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis [monoalkylated hydroxy naphthoic acid] aluminate; bis [dialkylated hydroxy naphthoic acid] aluminate wherein alkyl preferably contains 1 to about 6 carbon atoms; bis [trialkylated hydroxy naphthoic acid] aluminate wherein alkyl preferably contains 1 to about 6 carbon atoms; bis [tetraalkylated hydroxy naphthoic acid] aluminate wherein alkyl preferably contains 1 to about 6 carbon atoms; and the like in admixture with EMPHOS PS-900®, and more specifically, a positively charged liquid developer comprised of a nonpolar liquid, thermoplastic resin particles, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

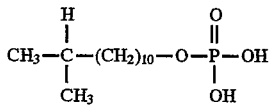

I.

mono

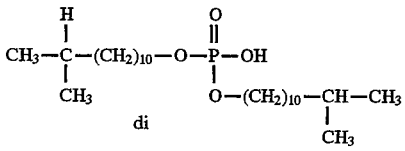

di

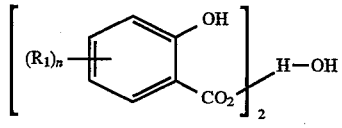

II.

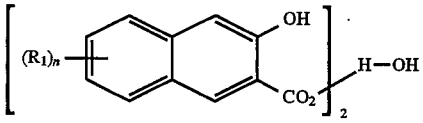

wherein R1 is selected from the group consisting of hydrogen and alkyl, and n represents a number.

Of importance with respect to the present invention is the selection of a cyclodextrin charge control agent, which agent is mixed with the toner resin and pigment, and thereafter a charge director is added thereto. Cyclodextrins are cyclic carbohydrate molecules comprised, for example, of 6, 7, or 8 glucose units, or segments which represent alpha, beta and gamma cyclodextrins, respectively, configured into a conical molecular structure with a hollow internal cavity. The chemistry of cyclodextrins is described in "*Cyclodextrin Chemistry*" by M. L. Bender and M. Komiyama, 1978, Springer-Verlag., the disclosure of which is totally incorporated herein by reference. The alpha, beta and gamma cyclodextrins are also known as cyclohexaamylose and cyclomaltolhexaose, cycloheptaamylose and cyclomaltoheptaose, and cyclooctaamylose and cyclomaltooctaose, respectively. The hollow interiors provide these cyclic molecules with the ability to complex and contain, or trap a number of molecules or ions, such as positively charged ions like benzene ring containing hydrophobic cations, which are known to insert themselves into the cyclotextrin cavities. It is further believed that smaller hydrophilic cations, such as protons that are transferred from the aqueous cores of charge director inverse micelles to the cyclodextrin CCA sites on the toner particles, are trapped not within the relatively spacious hydrophobic internal cyclodextrin cavity, but instead are trapped in the hydrophilic hydroxyl group ring structures surrounding the top and bottom openings of the conically shaped cyclodextrin molecules. The proton trapping is believed to occur via hydrogen bonding with said hydroxyl groups and their associated water molecules of hydration. In addition, modified cyclodextrins or cyclodextrin derivatives may also be used as charge control agents for the liquid developer of the present invention. In particular, cyclodextrin molecular derivatives containing basic organic functional groups, such as amines, amidines and guanidines, also trap protons via the formation of protonated nitrogen cationic species. Proton trapping is believed to be the mechanism by which the positively charged liquid toners of this invention receive their positive charging character.

Specific examples of cyclodextrins, many of which are available from American Maize Products Company, include the parent compounds, alpha cyclodextrin, beta cyclodextrin, and gamma cyclodextrin, and branched alpha, beta and gamma cyclodextrins, and substituted alpha, beta and gamma cyclodextrin derivatives having varying degrees of substitution. Alpha, beta and gamma cyclodextrin derivatives include 2-hydroxyethyl cyclodextrin, 2-hydroxypropyl cyclodextrin, acetyl cyclodextrin, methyl cyclodextrin, ethyl cyclodextrin, succinyl beta cyclodextrin, nitrate ester of cyclodextrin, N,N-diethylamino-N-2-ethyl cyclodextrin, N,N-morpholino-N-2 ethyl cyclodextrin, N,N-thiodiethylene-N-2-ethyl-cyclodextrin, and N,N-diethyleneaminomethyl-N-2-ethyl cyclodextrin wherein the degree of substitution can vary from 1 to 18 for alpha cyclodextrin derivatives, 1 to 21 for beta cyclodextrin derivatives, and 1 to 24 for gamma cyclodextrin derivatives. The degree of substitution is the extent to which cyclodextrin hydroxyl hydrogen atoms were substituted by the indicated named substituents in the derivatized cyclodextrins. Mixed cyclodextrin derivatives, containing 2 to 5 different substituents, and from 1 to 99 percent of any one substituent may also be used in this invention.

Additional alpha, beta, and gamma cyclodextrin derivatives include those prepared by reacting monochlorotriazinyl-beta-cyclodextrin, available from Wacker-Chemie GmbH as beta W7 MCT and having a degree of substitution of about 2.8, with organic basic compounds such as amines, amidines, and guanidines. Amine intermediates for reaction with the monochlorotriazinyl-beta-cyclodextrin derivative include molecules containing a primary or secondary aliphatic amine site, and a second tertiary aliphatic amine site within the same molecule so that after nucleophilic displacement of the reactive chlorine in the monochlorotriazinyl-beta-cyclodextrin derivative has occurred, the resulting cyclodextrin triazine CCA product retains its free tertiary amine site (for proton capture and charging the toner positively) even though the primary or secondary amine site was consumed in covalent attachment to the triazine ring. In addition, the amine intermediates may be difunctional in primary and/or secondary aliphatic amine sites and mono or multi-functional in tertiary amine sites so that after nucleophilic displacement of the reactive chlorine in the monochlorotriazinyl-beta-cyclodextrin derivative has occurred, polymeric forms of the resulting cyclodextrin triazine CCA (charge control additive) product result. Preferred amine intermediates selected to react with the monochlorotriazinyl-beta-cyclodextrin derivative to prepare tertiary amine bearing cyclodextrin derivatives include 4-(2-aminoethyl) morpholine, 4-(3-aminopropyl) morpholine, 1-(2-aminoethyl) piperidine, 1-(3-aminopropyl)-2-pipecoline, 1-(2-aminoethyl) pyrrolidine, 2-(2 -aminoethyl) -1-methylpyrrolidine, 1-(2-aminoethyl) piperazine, 1-(3-aminopropyl) piperazine, 4-amino-1-benzylpiperidine, 1-benzylpiperazine, 4-piperidinopiperidine, 2-dimethylaminoethyl amine, 1,4-bis (3-aminopropyl) piperazine, 1-(2-aminoethyl)piperazine, 4-(aminomethyl) piperidine, 4,4'-trimethylenedipiperidine, and 4,4'-ethylenedipiperidine. Preferred amidine and guanidine intermediates selected to react with the monochlorotriazinyl-beta-cyclodextrin derivative to prepare amidine and guanidine bearing cyclodextrin triazine CCA products after neutralization include formamidine acetate, formamidine hydrochloride, acetamidine hydrochloride, benzamidine hydrochloride, guanidine hydrochloride, guanidine sulfate, 2-guanidinobenzimidazole, 1-methylguanidine hydrochloride, 1,1-dimethylguanidine sulfate, and 1,1,3,3-tetramethylguanidine. Mixed cyclodextrins derived from the monochlorotriazinyl-beta-cyclodextrin derivative may contain 2 to 5 different substituents, and from 1 to 99 percent of any one substituent in this invention.

Cyclodextrins include those of the formulas

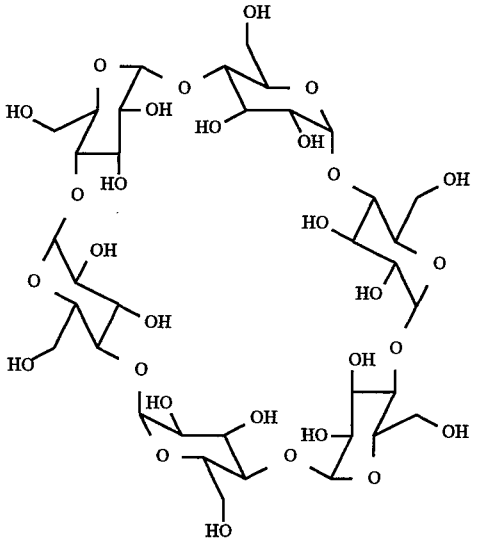
alpha-Cyclodextrin: 6 D-glucose rings containing-18 hydroxyl groups;
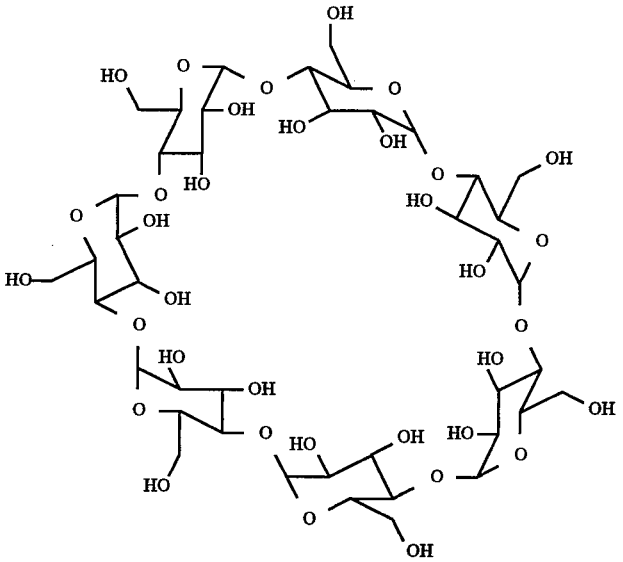
beta-Cyclodextrin: 7 D-glucose rings containing 21 hydroxyl groups;

-continued
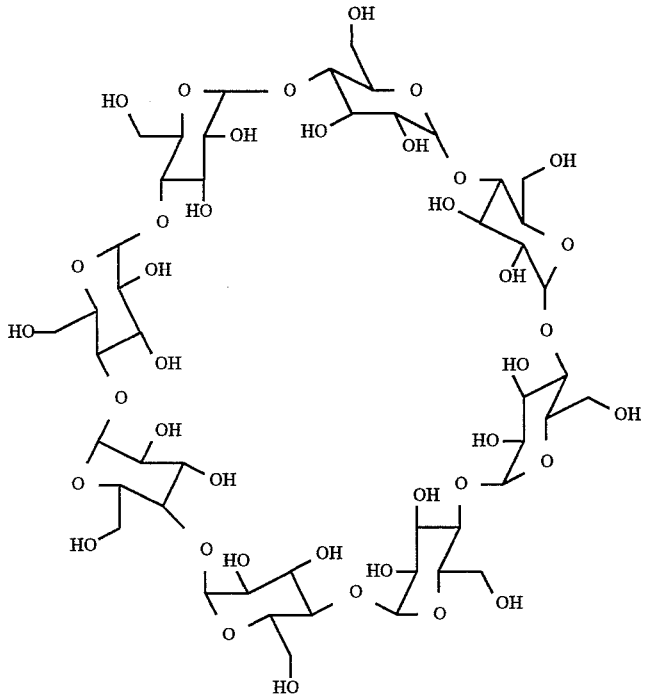
gamma-Cyclodextrin: 8 D-glucose rings containing 24 hydroxyl groups;
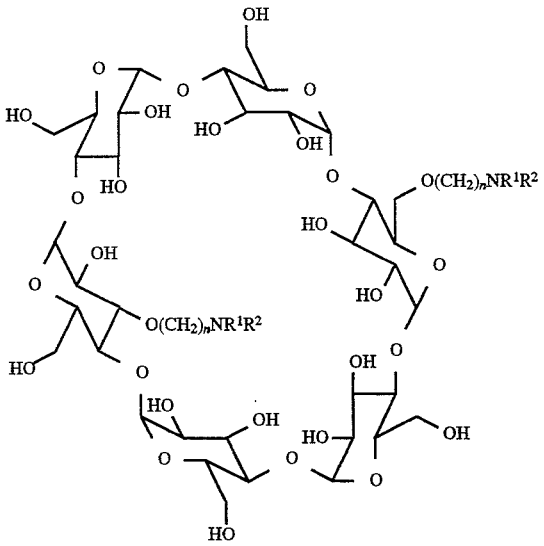
Tertiary Amino Alpha Cyclodextrin;

-continued

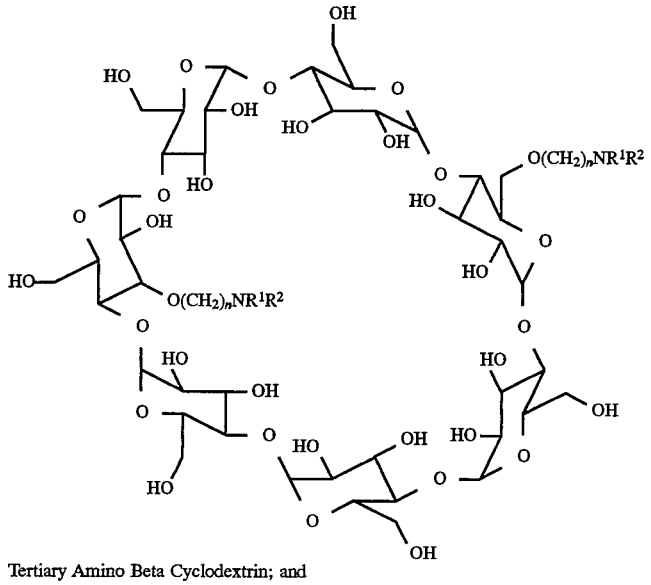

Tertiary Amino Beta Cyclodextrin; and

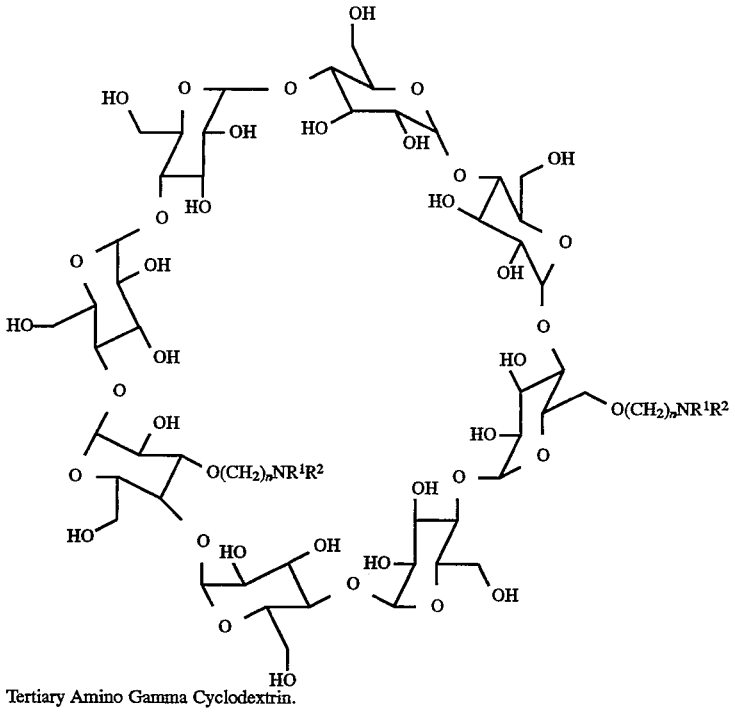

Tertiary Amino Gamma Cyclodextrin.

In embodiments of the present invention, the cyclodextrins are selected in various effective amounts, such as for example from about 0.05 to about 10, and preferably from about 3 to about 7 weight percent based on the total weight percent of the solids of resin, pigment, and cyclodextrin. For example, when 5 weight percent of cyclodextrin is selected, 55 weight percent of resin, and 40 weight percent of pigment is selected.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^{9}$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 85 to about 99.9 percent, and preferably from about 90 to about 99 percent by weight of the total developer dispersion, however, other effective amounts may be selected. The total solids, which include resin, pigment and the cyclodextrin charge control additive content of the developer in embodiments is, for example, 0.1 to 15 percent by weight, preferably 0.3 to 10 percent, and more preferably, 0.5 to 10 percent by weight.

Typical suitable thermoplastic toner resins can be selected for the liquid developers of the present invention in effective amounts, for example, in the range of about 99.9 percent to about 40 percent, and preferably 80 percent to 50 percent of developer solids comprised of thermoplastic resin, pigment, charge control agent, and in embodiments other components that may comprise the toner. Generally, developer solids include the thermoplastic resin, pigment and charge control agent. Examples of resins include ethylene vinyl acetate (EVA) copolymers (ELVAX® resins, E.I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention may optionally contain, and preferably does contain in embodiments a colorant dispersed in the resin particles. Colorants, such as pigments or dyes and mixtures thereof, are preferably present to render the latent image visible.

The colorant may be present in the toner in an effective amount of, for example, from about 0.1 to about 60 percent, and preferably from about 10 to about 50, and in embodiments 40 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, those pigments as illustrated in U.S. Pat. No. 5,223,368, the disclosure of which is totally incorporated herein by reference; other known pigments; and the like.

To further increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. These types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, charge control agent, and colorant in a manner that the resulting mixture contains, for example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight; cooling the dispersion to about 10° C. to about 30° C.; adding the aluminum charge director compound to the dispersion; and diluting the dispersion.

In the initial mixture, the resin, colorant and charge control agent may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60 percent solids. This mixture is then subjected to elevated temperatures during the initial mixing procedure to plasticize and soften the resin. The mixture is sufficiently heated to provide a uniform dispersion of all the solid materials of, for example, colorant, charge director, charge control, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods such as the use of a cooling fluid like water, glycols such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 4 hours. Additional liquid may be added at any time during the preparation of the liquid developer to facilitate grinding or to dilute the developer to the appropriate percent solids needed for developing. Thereafter, the charge director is added. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

Embodiments of the invention will be illustrated in the following nonlimiting Examples, it being understood that these Examples are intended to be illustrative only, and that the invention is not intended to be limited to the materials, conditions, process parameters and the like recited. The toner particle size can range from 0.1 to 3.0 micrometers and the preferred particle size range is 0.5 to 1.5 micrometers. Particle size, when measured, was measured by a Horiba CAPA-500 centrifugal automatic particle analyzer manufactured by Horiba Instruments, Inc., Irvine, Calif. The total developer charge (Q in microcoulombs) was measured using the series-capacitor technique. The charge in all samples was measured at 400 volts for 0.05 second.

Series-Capacitor Technique

Reference U.S. Pat. No. 5,459,077, the disclosure of which is totally incorporated herein by reference.

The electrical properties of liquid developers can be reviewed using a series-capacitor method, which is a well-established method for determining the dielectric relaxation time in partially conductive materials as, for example, might be found in "leaky" capacitors.

Two series capacitors can be used. One is comprised of a dielectric layer (MYLAR®) which corresponds to the photoreceptor, the other is comprised of a layer of liquid (ink). Although a constant bias voltage is maintained across the two capacitors, the voltage across the ink layer decays as the charged particles within it move. Measurement of the external currents allows the observation of the decay of voltage across the ink layer. Depending on the composition of the ink layer, this reflects the motion of charged species, in real time, as in the various, actual liquid immersion development processes of this invention.

Application of a co-developed theoretical analysis, together with a knowledge of the dielectric thicknesses of the MYLAR® and ink layers, the applied bias voltage and the observed current, enables the measurement of the total collected charge (Q).

EXAMPLES

Controls 1A and 1B=40 Percent of Rhodamine Y Magenta; No CCA

One hundred sixty-two (162.0) grams of ELVAX 200W® (a copolymer of ethylene and vinyl acetate with a melt index at 190° C. of 2,500, available from E.I. DuPont de Nemours & Company, Wilmington, Del.), 108.0 grams of the magenta pigment (Sun Rhodamine Y 18:3 obtained from Sun Chemicals) and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to the attritor at the conclusion of 2 hours, and cooled to 23° C. by running water through the attritor jacket, and ground in the attritor for an additional 2 hours. Additional ISOPAR-G®, about 300 grams, was added and the mixture was separated from the steel balls.

To 293.54 grams of the mixture (14.308 percent solids) were added 2499.46 grams of ISOPAR-G® (Exxon Corporation), and 14.0 grams of 1:1 Alohas/PS-900 (Witco) charge director (3 weight percent in ISOPAR-M®) to provide a charge director level of 10 milligrams of charge director per gram of toner solids (Control 1A). After print testing the Example 1A developer, an additional 14.0 grams of 1:1 Alohas/PS-900 (Witco) charge director (3 weight percent in ISOPAR-M®) were added to this developer to give a charge director level of 20 milligrams of charge director per gram of toner solids (Control 1B). The Control 1B developer was then print tested in the same way as was the Control 1A developer. The charge of the resulting liquid toner or developer after print testing was measured by the series capacitance method and was found to be 0.26 for the Control 1A developer and 0.25 for the Control 1B developer.

Alohas is hydroxy bis (3,5-di-tertiary butyl salicyclic) aluminate monohydrate, reference for example U.S. Pat. Nos. 5,366,840 and 5,324,613, the disclosures of which are totally incorporated herein by reference.

Controls 2A and 2B=40 Percent of Sun Pigment Yellow 17; No CCA

One hundred sixty-two (162.0) grams of ELVAX 200W® (a copolymer of ethylene and vinyl acetate with a melt index at 190° C. of 2,500, available from E. I. DuPont de Nemours & Company, Wilmington, Del.), 108.0 grams of the yellow pigment (Sun Pigment Yellow 17) and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to the attritor at the conclusion of the 2 hours, and cooled to 23° C. by running water through the attritor jacket, and ground in the attritor for an additional 2 hours. Additional ISOPAR-G®, about 300 grams, was added and the mixture was separated from the steel balls.

To 299.32 grams of the mixture (14.032 percent solids) were added 2493.68 grams of ISOPAR-G® (Exxon Corporation) and 7.0 grams of Alohas charge director (3 weight percent in ISOPAR-IM®) to provide a charge director level of 10 milligrams of charge director per gram of toner solids (Control 2A). After print testing the Example 2A developer, another 7.0 grams of Alohas charge director (3 weight percent in ISOPAR-M®) were added to the Example 2A developer to provide a charge director level of 20 milligrams of charge director per gram of toner solids (Control 2B). The Control 2B developer was then print tested in the same manner as Control 2A developer. The charge of the resulting liquid toner or developer after print testing was measured by the series capacitance method and was found to be 0.70 for the Control 2A developer and 0.84 for the Control 2B developer.

Examples 1A and 1B=40 Percent of Rhodamine Y Magenta; 5 Percent of beta-Cyclodextrin CCA One hundred forty-eight point five (148.5) grams of ELVAX 200W® (a copolymer of ethylene and vinyl acetate with a melt index at 190° C. of 2.500, available from E.I. DuPont de Nemours & Company, Wilmington, Del.), 108.0 grams of the magenta pigment (Sun Rhodamine Y 18:3), 13.5 grams of the charge additive beta-cyclodextrin (America Maize Products Company), and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to an attritor at the conclusion of the 2 hours, and cooled to 23° C. by running water through the attritor jacket, and ground in the attritor for an additional 2 hours. Additional ISOPAR-G®, about 300 grams, was added and the mixture was separated from the steel balls.

To 302.57 grams of the mixture (13.881 percent solids) were added 2,490.43 grams of ISOPAR-G® (Exxon Corporation), and 14.0 grams of 1:1 Alohas/PS-900 (Witco) charge director (3 weight percent in ISOPAR-M®) to provide a charge director level of 10 milligrams of charge director per gram of toner solids (Example 1A). After print testing the Example 1A developer, another 14.0 grams of 1:1 Alohas/PS-900 (Witco) charge director (3 weight percent in ISOPAR-M®) were added to the Example 1A developer to provide a charge director level of 20 milligrams of charge director per gram of toner solids (Example 1B). The Example 1B developer was then print tested in the same way as was the Example 1A developer. The charge of the resulting liquid toner or developer after print testing was measured by the series capacitance method and was found to be 0.32 for the Example 1A developer and 0.39 for the Example 1B developer.

Example 2A and 2B=40 percent of Rhodamine Y Magenta; 5 percent of N,N-diethylamino-N-2-ethyl cyclodextrin CCA One hundred forty-eight point five (148.5) grams of ELVAX 200W® (a copolymer of ethylene and vinyl acetate with a melt index at 190° C. of 2.500 available from E.I. DuPont de Nemours & Company, Wilmington, Del.), one hundred eight (108.0) grams of the magenta pigment (Sun Rhodamine Y 18:3), 13.5 grams of the charge additive N,N-diethylamino-N-2-ethyl cyclodextrin (American Maize Products Company), and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to the attritor at the conclusion of the 2 hours, and cooled to 23° C. by running water through the attritor jacket, and ground in the attritor for an additional 2 hours. Additional ISOPAR-G®, about 300 grams, was added and the mixture was separated from the steel balls.

To 290.60 grams of the mixture (14.453 percent solids) were added 2502.40 grams of ISOPAR-G® (Exxon Corporation), and 14.0 grams of 1:1 AlohasiPS-900 (Witco) charge director (3 weight percent in ISOPAR-M®) to give a charge director level of 10 milligrams of charge director per gram of toner solids (Example 2A). After print testing the Example 2A developer, another 14.0 grams of 1:1 Alohas/PS-900 (Witco) charge director (3 weight percent in ISOPAR-M®) were added to the Example 2A developer to give a charge director level of 20 milligrams of charge director per gram of toner solids (Example 2B). The Example 2B developer was then print tested in the same way as was the Example 2A developer. The charge of the resulting liquid toner or developer after print testing was measured by the series capacitance method and was found to be 0.42 for the Example 2A developer and 0.55 for the Example 2B developer.

Example 3A and 3B=40 percent of Sun Pigment Yellow 17; 5 percent of N,N-diethylamino-N-2-ethyl cyclodextrin CCA One hundred forty-eight point five (148.5) grams of ELVAX 200W® (a copolymer of ethylene and vinyl acetate with a melt index at 190° C. of 2,500 available from E.I. DuPont de Nemours & Company, Wilmington, Del.), 108.0 grams of the yellow pigment (Sun Pigment Yellow 17), 13.5 grams of the charge additive N,N-diethylamino-N-2-ethyl cyclodextrin (American Maize Products Company), and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to the attritor at the conclusion of the 2 hours, and cooled to 23° C. by running water through the attritor jacket, and ground in the attritor for an additional 2 hours. Additional ISOPAR-G®, about 300 grams, was added and the mixture was separated from the steel balls.

To 349.36 grams of the mixture (12.022 percent solids) were added 2,443.64 grams of ISOPAR-G® (Exxon Corporation) and 14.0 grams of Alohas charge director (3 weight percent in ISOPAR-M®) to give a charge director level of 10 milligrams of charge director per gram of toner solids (Example 3A). After print testing the Example 3A developer, another 14.0 grams of Alohas charge director (3 weight percent in ISOPAR-M®) were added to the Example 3A developer to give a charge director level of 20 milligrams of charge director per gram of toner solids (Example 3B). The Example 3B developer was then print tested in the same way as was the Example 3A developer. The charge of the resulting liquid toner or developer after print testing was measured by the series capacitance method and was found to be 0.37 for the Example 3A developer and 0.50 for the Example 3B developer. The toner average by area particle diameter was 1.0 micron as measured with a Horiba Capa 500 particle size analyzer.

The Xerox Color Graphx System 8936 is a 36 inch wide multiple pass ionographic printer. The printer parameters were adjusted to obtain a contrast of 50 and a speed of 2.0 ips by inputting values on the control panel. After single pass prints were made with the above parameter settings using the standard test printing mode (sail patterns), the residual development voltage was measured using an Electrostatic Volt Meter (Trek Model No. 565). This value is shown as residual voltage [($V_{out}$)]. This parameter is valuable because it is a measurement used to predict the amount of undesired color shifting (also referred to as staining) of the developed toner layer upon subsequent development passes. The reflective optical density (ROD), a color intensity measurement of chroma, was measured with a MacBeth 918 color densitometer using the substrate paper background as a reference. The paper used to test print these images was Rexham 6262.

A series of measurements were accomplished with the following results:

For Control 1A, which contained 40 weight percent of RHODAMINE Y magenta pigment and zero weight percent of CCA, and wherein the milligrams of charge director per gram of toner solids was 10/1; 1:1 by weight of Alohas/PS900, the total charge of the developer in microcoulombs was 0.26, the reflective optical density was 1.34, and the residual voltage was 55.

For Control 1B, which contained 40 weight percent of RHODAMINE Y magenta pigment and zero weight percent of CCA, and wherein the milligrams of charge director per gram of toner solids was 20/1; 1:1 by weight of AIohas/PS900, the total charge of the developer in microcoulombs was 0.25, the reflective optical density was 1.35, and the residual voltage was 60.

For Example 1A, which contained 40 weight percent of RHODAMINE Y magenta pigment and 5 weight percent of beta-cyclodextrin CCA, and wherein the milligrams of charge director per gram of toner solids was 10/1; 1:1 by weight of Alohas/PS900, the total charge of the developer in microcoulombs was 0.32, the reflective optical density was 1.37, and the residual voltage was 50.

For Example 1B, which contained 40 weight percent of RHODAMINE Y magenta pigment and 5 weight percent of beta-cyclodextrin CCA, and wherein the milligrams of charge director per gram of toner solids was 20/1; 1:1 by weight of Alohas/PS900, the total charge of the developer in microcoulombs was 0.39, the reflective optical density was 1.36, and the residual voltage was 43.

For Example 2A, which contained 40 weight percent of RHODAMINE Y magenta pigment and 5 weight percent of N,N-diethylamino-N-2-ethyl cyclodextrin CCA, and wherein the milligrams of charge director per gram of toner solids were 10/1; 1:1 by weight of Alohas/PS900, the total charge of the developer in microcoulombs was 0.42, the reflective optical density was 1.39, and the residual voltage was 50.

For Example 2B, which contained 40 weight percent of RHODAMINE Y magenta pigment and 5 weight percent of N,N-diethylamino-N-2-ethyl cyclodextrin CCA, and wherein the milligrams of charge director per gram of toner solids were 20/1; 1:1 by weight of Alohas/PS900, the total charge of the developer in microcoulombs was 0.55, the reflective optical density was 1.33, and the residual voltage was 40.

For Control 2A, which contained 40 weight percent of Sun Yellow 17 and no CCA, and wherein the milligrams of charge director per gram of toner solids were 10/1; Alohas, the total charge of the developer in microcoulombs was 0.7, the reflective optical density was 1.26, and the residual voltage was 41.

For Control 2B, which contained 40 weight percent of Sun Yellow 17 and no CCA, and wherein the milligrams of charge director per gram of toner solids were 20/1; Alohas, the total charge of the developer in microcoulombs was 0.84, the reflective optical density was 1.25, and the residual voltage was 82.

For Example 3A, which contained 40 weight percent of Sun Yellow 17 and 5 weight percent of N,N-diethylamino-N-2-ethyl cyclodextrin CCA, and wherein the milligrams of charge director per gram of toner solids were 10/1; Alohas, the total charge of the developer in microcoulombs was 0.37, the reflective optical density was 1.33, and the residual voltage was 56.

For Example 3B, which contained 40 weight percent of Sun Yellow 17 and 5 weight percent of N,N-diethylamino-N-2-ethyl cyclodextrin CCA, and wherein the milligrams of charge director per gram of toner solids were 20/1; Alohas, the total charge of the developer in microcoulombs was 0.5, the reflective optical density was 1.31, and the residual voltage was 50.

For improved image quality in multi-layered images, it is preferred that RODs increase, which increase permits more intense color or chroma, and $V_{outs}$ decrease, which minimize color staining or hue shifts of a magenta image after overcoating said magenta image with a yellow toner. The thickness of a developed layer, e.g. yellow, is dependent upon the charging level (proportional to applied voltage) on the dielectric receptor. Since a constant voltage is generally applied to the dielectric receptor in development of all layers in a multi-layered image, large residual voltages, as might occur after development of the magenta layer, add to the applied voltage resulting in a thicker yellow layer. A thicker yellow layer overlaid on the thinner magenta layer will cause the latter to color shift towards orange. Review of the measurements and data presented herein indicates that increasing the charge director level in the no CCA magenta control developers, Controls 1A and 1B, failed to increase the developer charging levels (total Q), and reflective optical densities (ROD) of the developed magenta images remained essentially constant, but residual voltages ($V_{out}$) increased. When 5 percent beta cyclodextrin CCA was incorporated into what was otherwise the same magenta developer formulations as were used in Controls 1A and 1B, Examples 1A and 1B magenta developers were produced with charging levels of 0.32 and 0.39 versus 0.26 and 0.25 for the corresponding Control developers 1A and 1B when using the same charge director (CD) and levels thereof. Although the RODs of the developed magenta layers increased only slightly in Examples 1A and 1B versus Controls 1A and 1B, the residual voltages ($V_{out}$) on the developed magenta toner layers decreased significantly to 50 and 43 volts, down from 55 and 60 volts in the corresponding no CCA developers in Controls 1A and 1B. The residual voltage differences were particularly significant for the magenta developer charged with 20/1 of the designated charge director. By increasing the magenta developer charging level in Example 1B to 0.39 from 0.25 in Control 1B, it is believed that the conductivity of the developer also increased slightly causing the developed magenta layer residual voltage in Example 1B to decrease, while not decreasing reflective optical density (ROD of 1.36) versus Control 1B (ROD of 1.35). Side by side inspection of Example 1B and Control 1B (magenta images overcoated with yellow images) images indicated a visually observable color shift of the Control 1B image towards orange versus the Example 1B image when both sets of prints were made using identical machine printing parameters.

When 5 percent of the N,N-diethylamino-N-2-ethyl beta cyclodextrin CCA was incorporated into what was otherwise the same magenta developer formulations as were used in Controls 1A and 1B, Examples 2A and 2B magenta developers were produced with charging levels (total Q) further increased to 0.42 and 0.55 versus 0.26 and 0.25 for the corresponding magenta Control 1A and 1B developers when using the same charge director (CD) and levels thereof. The N,N-diethylamino-N-2-ethyl beta cyclodextrin CCA, in conjunction with the same levels of the same charge director, produced magenta developers with yet higher charging levels than those obtained for the beta cyclodextrin CCA magenta developer (Examples 1A and 1B) or the no CCA magenta developers (Controls 1A and 1B). However, as magenta developer charging levels increased, the reflective optical densities (ROD) of the developed magenta layers reached a maximum and then decreased slowly (compare Examples 2B, 1B and Control 1B) while at the same time the benefit of decreasing residual voltage (compare Examples 2B, 1B and Control 1B again) appeared to have been lost. Thus, an upper developer charging limit of diminishing returns was reached at which point reflective optical density (ROD) did not further increase and residual voltage ($V_{out}$) did not further decrease. For the magenta developers of this invention, the larger realized image quality improvement parameter was the decrease in residual voltage and the smaller improvement was the increase in reflective optical density. Both improvements can be attributed to the presence of a cyclodextrin charge control agent. The lowering of residual voltage in the developed magenta layer is a significant development parameter improvement because magenta layer color shifts are minimized after developing a yellow toner overlayer of about equal thickness.

Review of the measurements and data presented herein indicates that increasing the charge director level in the no CCA yellow control developers, Controls 2A and 2B, did increase the developer charging levels (total Q) while the reflective optical densities (ROD) of the developed yellow images remained essentially constant, but at the expense of doubling residual voltage ($Vo_{out}$ increased from 41 to 82). When 5 percent of the tertiary amine beta cyclodextrin CCA was incorporated into what was otherwise the same yellow developer formulations as were used in Controls 2A and 2B, Examples 3A and 3B yellow developers were produced with total Q charging levels of 0.37 and 0.50 versus 0.70 and 0.84 for the corresponding Control 2A and 2B developers when using the same charge director (CD) and levels thereof. Although the developer charging levels (total Q) decreased in Examples 3A and 3B, the important image quality variable of reflective optical density increased to 1.33 and 1.31 from the corresponding ROD values of 1.26 and 1.25 in the Control 2A and 2B developers indicating higher yellow chroma images were obtained when the inventive CCA was incorporated into the developer formulation. Side by side visual inspection of the Example 3A and 3B images and the Control 2A and 2B images indicated more color intensity in the former prints when both sets of prints were made using identical machine printing parameters. It is believed that developers with high charging levels, as in Controls 2A and 2B, contain toner particles having large numbers of charges per particle (an excess of charge) wherein fewer of these highly charged particles can (versus toner particles having a nominal number of charges per particle) totally discharge the dielectric receptor. As a result, less developed toner mass is deposited from highly charged toner particles and lower reflective image optical densities (RODs) are obtained for a given set of machine development parameters. Although the residual voltages ($V_{out}$) for Examples 3A and 3B developers may not be as low as desired (40 to 45 volts) for prevention of color (hue) shifts in the next developed toner layer, color shifts are not important when developing the yellow toners of this invention because the yellow toner is developed last; that is no other toner layers were developed over the yellow toner layer.

The higher charging levels (total Q) obtained for the yellow developers versus the magenta developers of this invention reflects, for example, the large influence of pigment type on the initial (in the absence of CCA) developer charging level. The incorporation of the inventive cyclodextrin charge control agents into the developer formulation modulates the initial developer charging level to a new developer charging level having either the same or a larger reflective optical density, but a lower residual voltage as was found for the magenta developers, or a higher reflective optical density and a similar or slightly higher residual voltage as was found for the yellow developers. Thus, the CCAs of our invention simultaneously tune charging level (total Q), reflective optical density (ROD) and residual voltage ($V_{out}$).

Other embodiments and modifications of the present invention may occur to those skilled in the art subsequent to a review of the information presented herein; these embodiments and modifications, as well as equivalents thereof, are also included within the scope of this invention.

What is claimed is:

1. A positively charged liquid developer comprised of a nonpolar liquid, thermoplastic resin particles, pigment, a charge director, and a charge control agent is a cyclodextrin or a cyclodextrin derivative containing one or more organic basic amino groups.

2. A developer in accordance with claim 1 wherein said charge control agent is unsubstituted alpha, beta or gamma cyclodextrin or mixtures thereof of the following formulas

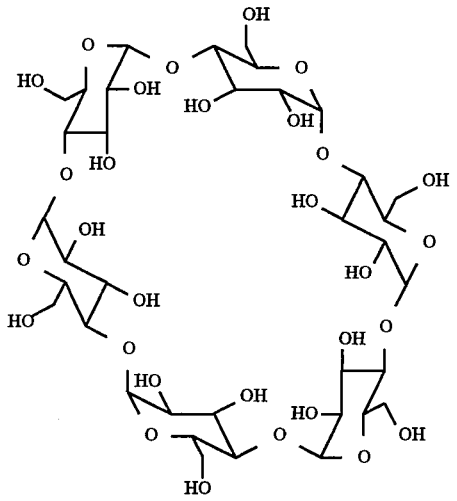

alpha-Cyclodextrin:

6 D-glucose rings containing 18 hydroxyl groups;

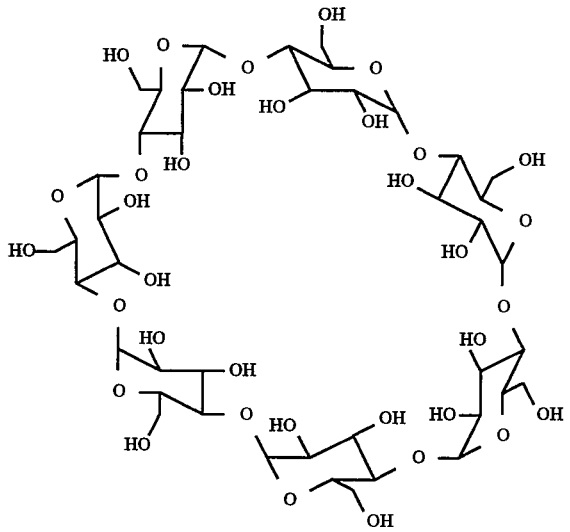

beta-Cyclodextrin:

7 D-glucose rings containing 21 hydroxyl groups; or

-continued

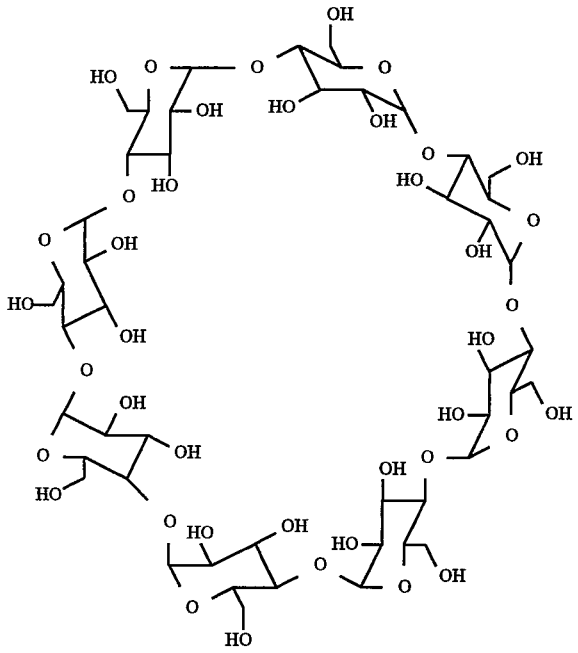

gamma-Cyclodextrin:

8 D-glucose rings containing 24 hydroxyl groups.

3. A developer in accordance with claim 1 wherein said charge control agent is a tertiary aliphatic amino derivative of alpha, beta or gamma cyclodextrin or mixtures thereof of the following formulas wherein n is an integer of from 2 to 30, and $R^1$ and $R^2$ is an alkyl group containing from 2 to 30 carbons, or an alkylaryl group containing from 7 to 31 carbons, or a cycloalkyl or alkylcycloalkyl group containing from 3 to 30 carbons, or a cycloalkyl or heterocycloalkyl group containing from 3 to 30 carbons wherein R1 and R2 are joined in a ring structure with a covalent bond or by covalent bonding to a common divalent heteroatom of oxygen, sulfur or another tertiary alkyl nitrogen group wherein the degree of substitution can vary from 1 to 18, or 21, or 24 of the hydroxyl groups of the selected cyclodextrin

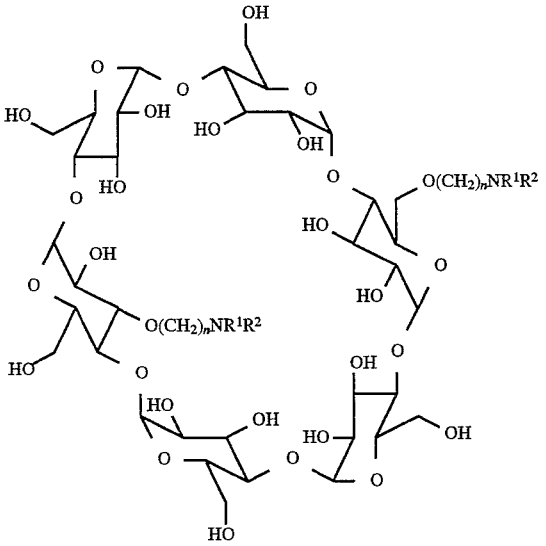
Tertiary Amino Alpha Cyclodextrin;
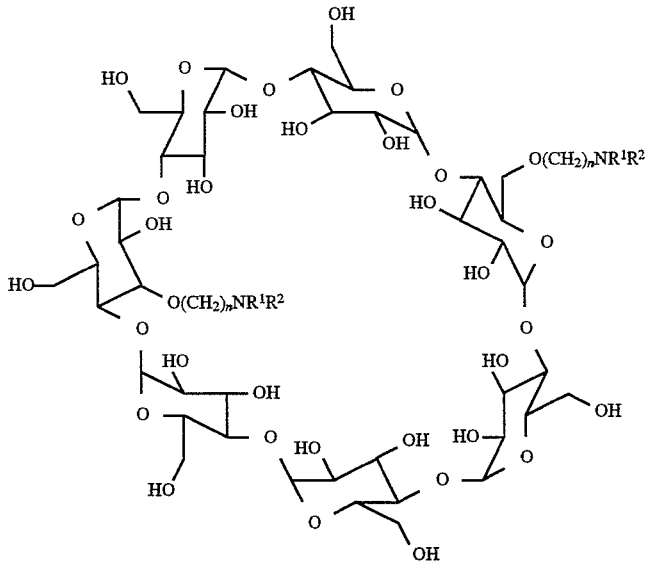
Tertiary Amino Beta Cyclodextrin; or -continued

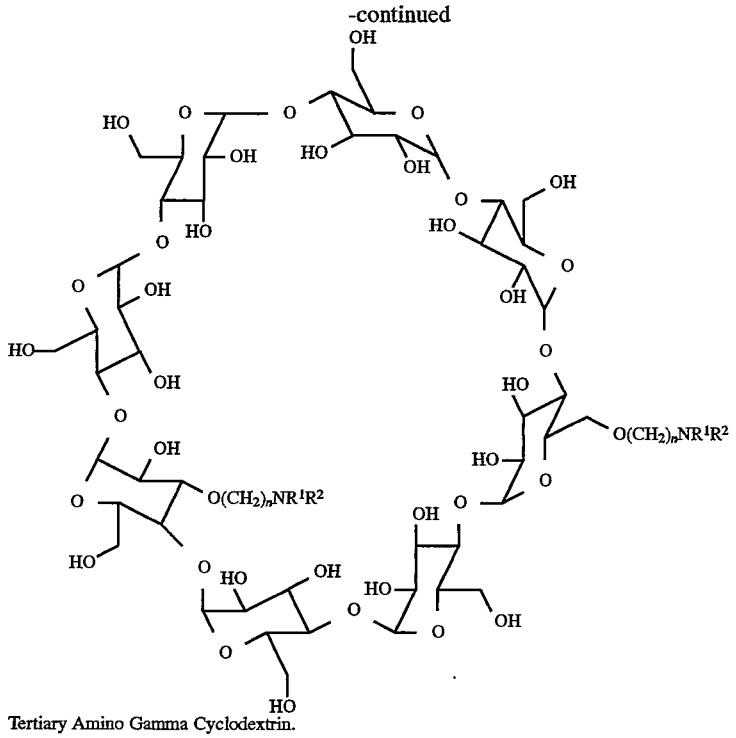

Tertiary Amino Gamma Cyclodextrin.

4. A liquid developer in accordance with claim 2 wherein said liquid has a viscosity of from about 0.5 to about 20 centipoise and resistivity equal to or greater than $5\times10^9$, and said thermoplastic resin particles have a volume average particle diameter of from about 0.1 to about 30 microns.

5. A developer in accordance with claim 2 wherein the resin is a copolymer of ethylene and vinyl acetate.

6. A developer in accordance with claim 1 wherein the pigment is present in an amount of from about 0.1 to about 60 percent by weight based on the total weight of the developer solids.

7. A developer in accordance with claim 1 wherein the pigment is carbon black, cyan, magenta, yellow or mixtures thereof.

8. A developer in accordance with claim 1 wherein the charge control agent is present in an amount of from about 0.05 to about 10 weight percent based on the weight of the developer solids of resin, pigment and charge control agent.

9. A developer in accordance with claim 1 wherein the cyclodextrin is alpha cyclodextrin.

10. A developer in accordance with claim 1 wherein the cyclodextrin is beta cyclodextrin.

11. A developer in accordance with claim 1 wherein the cyclodextrin is gamma cylodextrin.

12. A developer in accordance with claim 1 wherein the cyclodextrin is N,N-diethylamino-N-2-ethyl beta cyclodextrin.

13. A developer in accordance with claim 1 wherein the liquid for said developer is an aliphatic hydrocarbon.

14. A developer in accordance with claim 13 wherein the aliphatic hydrocarbon is a mixture of branched hydrocarbons of from about 8 to about 16 carbon atoms, or a mixture of normal hydrocarbons of from about 8 to about 16 carbon atoms.

15. A developer in accordance with claim 13 wherein the aliphatic hydrocarbon is a mixture of branched hydrocarbons of from about 8 to about 16 carbon atoms.

16. A developer in accordance with claim 1 wherein the resin is an alkylene polymer, a styrene polymer, an acrylate polymer, a polyester, or mixtures thereof.

17. An imaging method which comprises forming an electrostatic latent image followed by the development thereof with the liquid developer of claim 1.

18. An ionographic imaging method which comprises charging a receptor followed by the development thereof with the developer of claim 1.

19. A developer in accordance with claim 1 wherein said director is a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

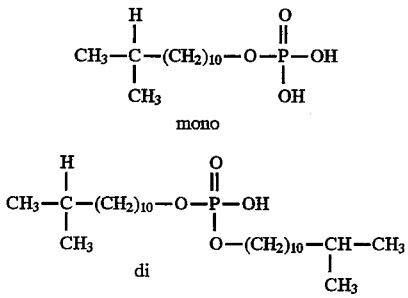

II.

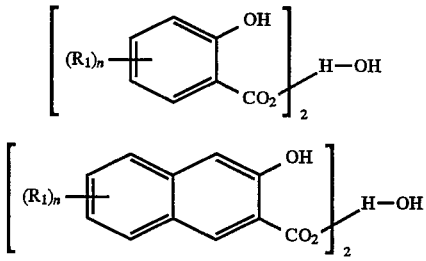

wherein R1 is selected from the group consisting of hydrogen and alkyl, and n represents a number.

20. A developer in accordance with claim 1 wherein said developer further includes a charge adjuvant.

21. A positively charged liquid developer comprised of a nonpolar liquid, thermoplastic resin particles, pigment, a charge director, and a charge control agent comprised of a cyclodextrin.

22. A developer in accordance with claim 21 wherein the cyclodextrin is alpha cyclodextrin.

23. A developer in accordance with claim 21 wherein the cyclodextrin is beta cyclodextrin.

24. A developer in accordance with claim 21 wherein the cyclodextrin is gamma cylodextrin.

* * * * *